US009416476B2

(12) United States Patent
Wong

(10) Patent No.: US 9,416,476 B2
(45) Date of Patent: Aug. 16, 2016

(54) LAUNDRY TREATING APPLIANCE AND METHOD OF CONTROLLING THE HEATER THEREOF

(75) Inventor: Nyik Siong Wong, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 743 days.

(21) Appl. No.: 13/483,344

(22) Filed: May 30, 2012

(65) Prior Publication Data

US 2013/0318724 A1 Dec. 5, 2013

(51) Int. Cl.
*D06F 33/02* (2006.01)

(52) U.S. Cl.
CPC ..... *D06F 33/02* (2013.01)

(58) Field of Classification Search
CPC ..... D06F 33/02
See application file for complete search history.

(56) References Cited

U.S. PATENT DOCUMENTS

| | | | | |
|---|---|---|---|---|
| 3,612,500 | A | 10/1971 | Cramer et al. | |
| 3,942,265 | A | 3/1976 | Sisler et al. | |
| 5,193,292 | A * | 3/1993 | Hart et al. | 34/491 |
| 7,594,343 | B2 | 9/2009 | Woerdehoff et al. | |
| 8,042,284 | B2 | 10/2011 | Yoo et al. | |
| 8,093,536 | B2 | 1/2012 | Kim | |
| 2007/0062061 | A1 | 3/2007 | Carow | |
| 2008/0098615 | A1 * | 5/2008 | Kim | 34/493 |

FOREIGN PATENT DOCUMENTS

| | | | |
|---|---|---|---|
| EP | 0362676 | B1 | 4/1994 |
| GB | 964054 | A | 7/1964 |

* cited by examiner

*Primary Examiner* — Jason Ko

(57) ABSTRACT

A method of operating a laundry treating appliance to adjust the thermal output of the heater to control the total power consumption of the washing machine.

14 Claims, 3 Drawing Sheets

LAUNDRY TREATING APPLIANCE AND METHOD OF CONTROLLING THE HEATER THEREOF

BACKGROUND

Laundry treating appliances, such as clothes washing machines and clothes dryers, may include current drawing components for treating laundry items in a rotatable drum that defines a treating chamber according to a cycle of operation. The current drawing components may include a motor or a heating element. Current/power drawn by the components may be controlled to avoid circuit breaker tripping.

BRIEF SUMMARY

According to an embodiment of the invention, a method of operating a laundry treating appliance having a drum at least partially defining a treating chamber, and a plurality of electrical components including a motor rotatably driving the drum, and a heater heating fluid provided to the treating chamber, comprises determining a parameter indicative of the electricity consumed by at least some of the plurality of electrical components and providing the parameter to the controller, comparing, with the controller, the consumed electricity to a threshold value for the parameter, and adjusting the thermal output of the heater to maintain the parameter below the threshold value.

DETAILED DESCRIPTION

Figure 1:
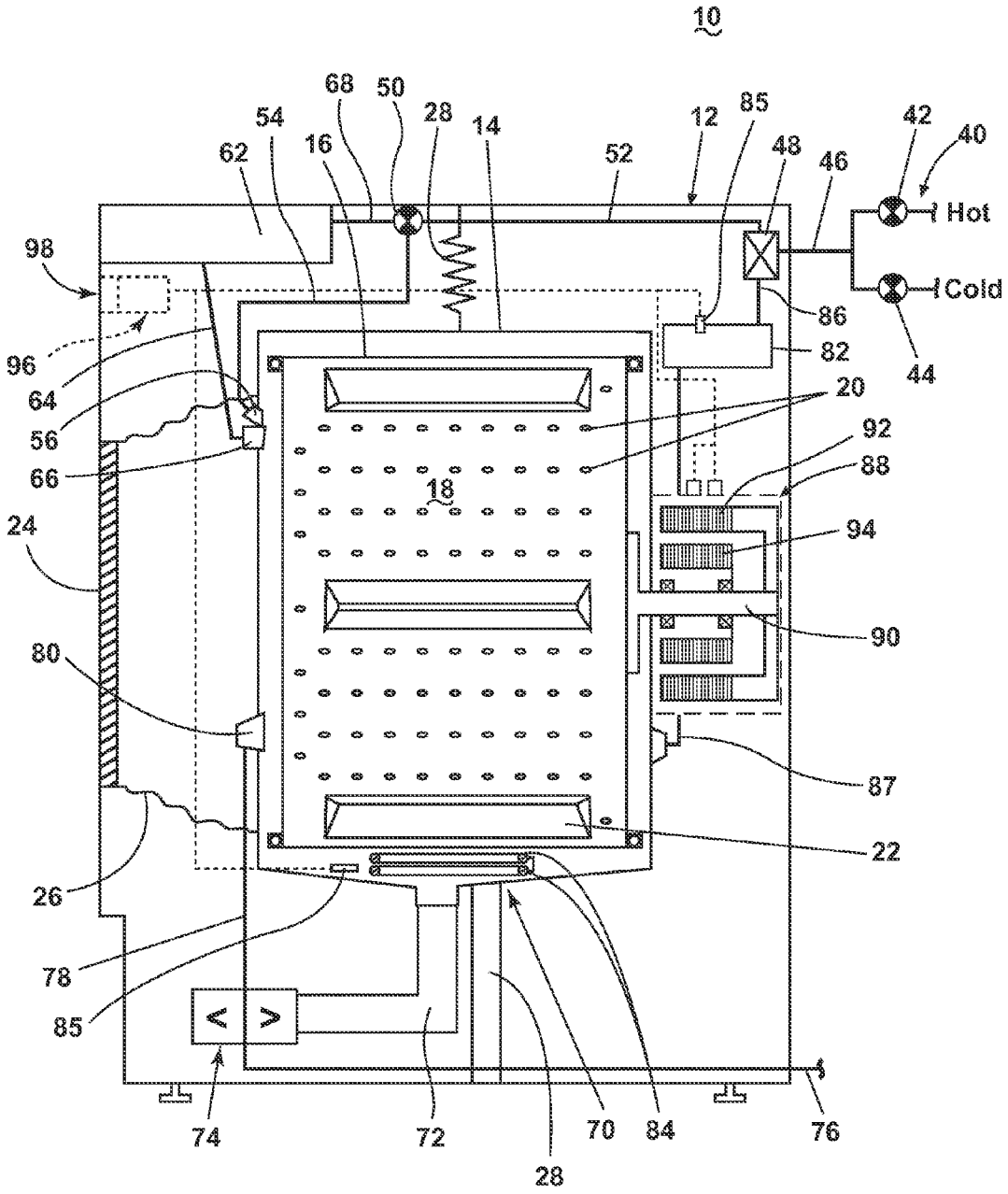
FIG. 1 is a schematic view of a laundry treating appliance in the form of a washing machine according to a first embodiment of the invention.

FIG. 1 is a schematic view of a laundry treating appliance according to a first embodiment of the invention. The laundry treating appliance may be any appliance which performs a cycle of operation to clean or otherwise treat items placed therein, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine.

The laundry treating appliance of FIG. 1 is illustrated as a washing machine 10, which may include a structural support system comprising a cabinet 12 which defines a housing within which a laundry holding system resides. The cabinet 12 may be a housing having a chassis and/or a frame, defining interior enclosing components typically found in a conventional washing machine, such as motors, pumps, fluid lines, controls, sensors, transducers, and the like. Such components will not be described further herein except as necessary for a complete understanding of the invention.

The laundry holding system comprises a tub 14 supported within the cabinet 12 by a suitable suspension system and a drum 16 provided within the tub 14, the drum 16 defining at least a portion of a laundry treating chamber 18. The drum 16 may include a plurality of perforations 20 such that liquid may flow between the tub 14 and the drum 16 through the perforations 20. A plurality of baffles 22 may be disposed on an inner surface of the drum 16 to lift the laundry load received in the treating chamber 18 while the drum 16 rotates. It is also within the scope of the invention for the laundry holding system to comprise only a tub with the tub defining the laundry treating chamber.

The laundry holding system may further include a door 24 which may be movably mounted to the cabinet 12 to selectively close both the tub 14 and the drum 16. A bellows 26 may couple an open face of the tub 14 with the cabinet 12, with the door 24 sealing against the bellows 26 when the door 24 closes the tub 14.

The washing machine 10 may further include a suspension system 28 for dynamically suspending the laundry holding system within the structural support system.

The washing machine 10 may further include a liquid supply system for supplying water to the washing machine 10 for use in treating laundry during a cycle of operation. The liquid supply system may include a source of water, such as a household water supply 40, which may include separate valves 42 and 44 for controlling the flow of hot and cold water, respectively. Water may be supplied through an inlet conduit 46 directly to the tub 14 by controlling first and second diverter mechanisms 48 and 50, respectively. The diverter mechanisms 48, 50 may be a diverter valve having two outlets such that the diverter mechanisms 48, 50 may selectively direct a flow of liquid to one or both of two flow paths. Water from the household water supply 40 may flow through the inlet conduit 46 to the first diverter mechanism 48 which may direct the flow of liquid to a supply conduit 52. The second diverter mechanism 50 on the supply conduit 52 may direct the flow of liquid to a tub outlet conduit 54 which may be provided with a spray nozzle 56 configured to spray the flow of liquid into the tub 14. In this manner, water from the household water supply 40 may be supplied directly to the tub 14.

The washing machine 10 may also be provided with a dispensing system for dispensing treating chemistry to the treating chamber 18 for use in treating the laundry according to a cycle of operation. The dispensing system may include a dispenser 62 which may be a single use dispenser, a bulk dispenser or a combination of a single and bulk dispenser.

Regardless of the type of dispenser used, the dispenser 62 may be configured to dispense a treating chemistry directly to the tub 14 or mixed with water from the liquid supply system through a dispensing outlet conduit 64. The dispensing outlet conduit 64 may include a dispensing nozzle 66 configured to dispense the treating chemistry into the tub 14 in a desired pattern and under a desired amount of pressure. For example, the dispensing nozzle 66 may be configured to dispense a flow or stream of treating chemistry into the tub 14 by gravity, i.e. a non-pressurized stream. Water may be supplied to the dispenser 62 from the supply conduit 52 by directing the diverter mechanism 50 to direct the flow of water to a dispensing supply conduit 68.

Non-limiting examples of treating chemistries that may be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The washing machine 10 may also include a recirculation and drain system for recirculating liquid within the laundry holding system and draining liquid from the washing machine 10. Liquid supplied to the tub 14 through tub outlet conduit 54 and/or the dispensing supply conduit 68 typically enters a space between the tub 14 and the drum 16 and may flow by gravity to a sump 70 formed in part by a lower portion of the tub 14. The sump 70 may also be formed by a sump conduit 72 that may fluidly couple the lower portion of the tub 14 to a pump 74. The pump 74 may direct liquid to a drain conduit 76, which may drain the liquid from the washing machine 10, or to a recirculation conduit 78, which may terminate at a recirculation inlet 80. The recirculation inlet 80 may direct the liquid from the recirculation conduit 78 into the drum 16. The recirculation inlet 80 may introduce the liquid into the drum 16 in any suitable manner, such as by spraying, dripping, or providing a steady flow of liquid. In this manner, liquid provided to the tub 14, with or without treating chemistry may be recirculated into the treating chamber 18 for treating the laundry within.

The liquid supply and/or recirculation and drain system may be provided with a heating system which may include one or more heaters for heating laundry and/or liquid supplied to the tub 14, such as a steam generator 82 and/or a sump heater 84. Liquid from the household water supply 40 may be provided to the steam generator 82 through the inlet conduit 46 by controlling the first diverter mechanism 48 to direct the flow of liquid to a steam supply conduit 86. Steam generated by the steam generator 82 may be supplied to the tub 14 through a steam outlet conduit 87. The steam generator 82 may be any suitable type of steam generator such as a flow through steam generator or a tank-type steam generator. Alternatively, the sump heater 84 may be used to generate steam in place of or in addition to the steam generator 82. In addition or alternatively to generating steam, the steam generator 82 and/or sump heater 84 may be used to heat the laundry and/or liquid within the tub 14 as part of a cycle of operation.

The heater, such as the sump heater 84 or the steam generator 82, may include one or more heating elements. For example, the sump heater 84 may include dual heating elements for heating laundry and/or liquid in the tub 14 or a single heating element with separately energizable portions. In another embodiment, the sump heater 84 may include more than two heating elements. Each of the dual heating elements may be configured to have identical thermal output capability, while combining heating elements with different thermal output capabilities are also possible. Similarly, the steam generator 82 may include multiple heating elements in generating steam for treating laundry.

One or more temperature sensors 85 may be provided to the sump 70 or other suitable locations of the washing machine 10 to operably measure the temperature of the sump heater 84, atmosphere in the tub 14, and/or liquid supplied to the tub 14. The temperature sensor 85, without limitation, may be in the form of NTC temperature sensor or PTC temperature sensor. The temperature sensor 85 may be also coupled to the steam generator 82 to measure the temperature of the steam generator to provide the temperature to the controller 96.

Additionally, the liquid supply and recirculation and drain system may differ from the configuration shown in FIG. 1, such as by inclusion of other valves, conduits, treating chemistry dispensers, sensors, such as water level sensors and weight sensor, and the like, to control the flow of liquid through the washing machine 10 and for the introduction of more than one type of treating chemistry.

The washing machine 10 also includes a drive system for rotating the drum 16 within the tub 14. The drive system may include a motor 88, which may be directly coupled with the drum 16 through a drive shaft 90 to rotate the drum 14 about a rotational axis during a cycle of operation. The motor 88 may be a brushless permanent magnet (BPM) motor having a stator 92 and a rotor 94. Alternately, the motor 88 may be coupled to the drum 16 through a belt and a drive shaft to rotate the drum 16, as is known in the art. Other motors, such as an induction motor or a permanent split capacitor (PSC) motor, may also be used. The motor 88 may rotate the drum 16 at various speeds in either rotational direction.

The motor 88 may include a motor torque sensor (not shown). The motor torque sensor may be any suitable sensor, such as a voltage or current sensor, for outputting a parameter, such as a continuous or discrete current or voltage signal, indicative of the current or voltage supplied to the motor 88 to determine the torque applied by the motor 88. The motor torque sensor may be a physical sensor or may be integrated with the motor 88.

The washing machine 10 also includes a control system for controlling the operation of the washing machine 10 to implement one or more cycles of operation. The control system may include a controller 96 located within the cabinet 12 and a user interface 98 that is operably coupled with the controller 96. The user interface 98 may include one or more knobs, dials, switches, displays, touch screens and the like for communicating with the user, such as to receive input and provide output. The user may enter different types of information including, without limitation, cycle selection and cycle parameters, such as cycle options.

The controller 96 may include the machine controller and any additional controllers provided for controlling any of the components of the washing machine 10. For example, the controller 96 may include the machine controller and a motor controller. Many known types of controllers may be used for the controller 96. The specific type of controller is not germane to the invention. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), may be used to control the various components.

Figure 2:
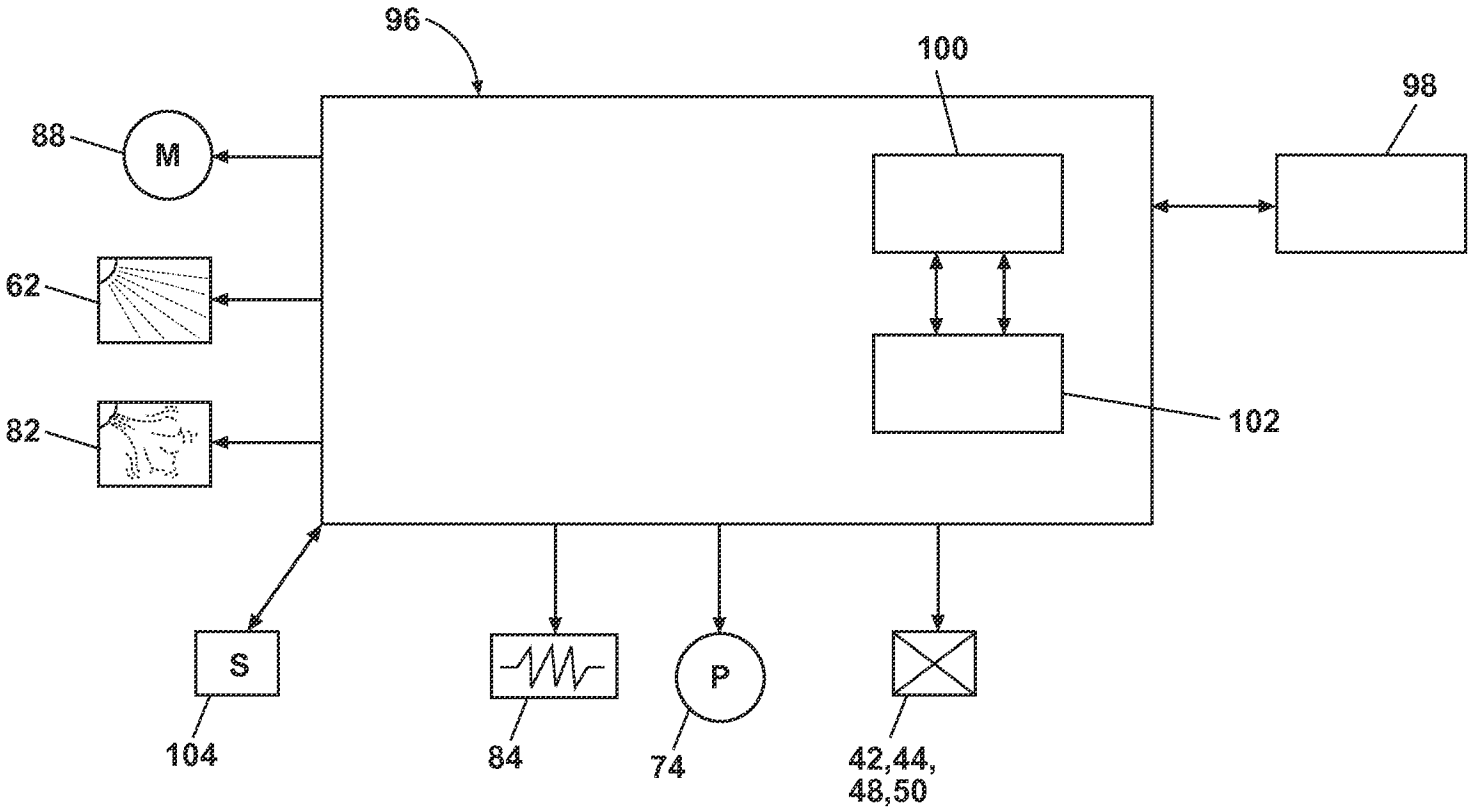
FIG. 2 is a schematic of a control system of the laundry treating appliance of FIG. 1 according to the first embodiment of the invention.

As illustrated in FIG. 2, the controller 96 may be provided with a memory 100 and a central processing unit (CPU) 102. The memory 100 may be used for storing the control software that is executed by the CPU 102 in completing a cycle of operation using the washing machine 10 and any additional software. Examples, without limitation, of cycles of operation include: wash, heavy duty wash, delicate wash, quick wash, pre-wash, refresh, rinse only, and timed wash. The memory 100 may also be used to store information, such as a database or table, and to store data received from one or more components of the washing machine 10 that may be communicably coupled with the controller 96. For example, the current/power requirement for current drawing components may be stored in the memory 100. The current/power threshold for the washing machine 10 may be also stored in the table in the form of factory default values. The database or table may be used to store the various operating parameters for the one or more cycles of operation, including factory default values for the operating parameters and any adjustments to them by the control system or by user input.

The controller 96 may be operably coupled with one or more components of the washing machine 10 for communicating with and controlling the operation of the component to complete a cycle of operation. For example, the controller 96 may be operably coupled with the motor 88, the pump 74, the dispenser 62, the steam generator 82 and the sump heater 84 to control the operation of these and other components to implement one or more of the cycles of operation.

The controller 96 may also be coupled with one or more sensors 104 provided in one or more of the systems of the washing machine 10 to receive input from the sensors, which are known in the art and not shown for simplicity. Non-limiting examples of sensors 104 that may be communicably coupled with the controller 96 include: a temperature sensor 85, a moisture sensor, a weight sensor, a chemical sensor, a position sensor, a motor torque sensor.

In one example, the motor torque sensor may be operably coupled to the controller 96 to provide the torque information to the controller 96. The torque information may be provided to the controller 96 in the form of speed, current, voltage, or torque. For example, the amount of current drawn by the motor 88 for rotating the drum 14 at a speed may be received by the controller 96, and then stored in the memory 100 of the controller 96.

The power consumption of other current drawing components may be also separately provided to the controller 96. For example, the signal from the temperature sensor 85 coupled to the sump heater 84 or steam generator 82 may be provided to the controller 96 to determine the power supplied to the heating elements of sump heater 84 or steam generator 82. The pump 74 may be provided with a current or voltage sensor to determine the current or voltage information applied to the motor of the pump 74. The controller 96 may convert the current, voltage, temperature or other signals that are received from each component to power consumption by executing the control software stored in the controller 96.

It may be understood that in most cases the power consumption of washing machine 10 is directly related to the treating capacity of the washing machine 10. Increasing the treating capacity of the washing machine 10 may require increased drum size, which necessitates higher motor torque and increase current/power consumption. While it may be required to replace a small torque motor with a higher torque motor for the washing machine 10 with high treating capacity, it may be noted the total power consumption of the washing machine 10 may also need to be considered. The washing machine may be typically provided with a maximum allowable current for operating the washing machine according to a cycle of operation. The maximum allowable current level may be determined for the washing machine such that summation of current drawn by all components of the washing machine need to be maintained below the maximum allowable current threshold to avoid tripping. For example, in the United States, where a 115V, 15 ampere electrical supply is common, 12 ampere may be set as the maximum current threshold that may be drawn for the washing machine from the circuit breaker for operating a cycle of operation of the washing machine. The 12 ampere maximum is below that of the supply and provides a suitable safety margin. However, higher maximums can be set. The maximum current, in most cases, will be dependent on the electrical supply. The 115V, 15 ampere example is for illustration only, and is not meant to be limiting.

Due to the maximum current/power threshold allowed for the washing machine 10, when more current/power is drawn to a component, such as the motor, than is required, only reduced current/power resources may be available for remaining components. For example, if the motor 88 draws more current than is designed, only reduced amount of current may be available for the operation of another current drawing component to avoid tripping of a breaker for the electrical supply.

In the clothes washer, the heater, such as the sump heater 84, is another component, like the motor 88, which draws a relatively large amount of the available power under normal operating conditions to function properly. If it is necessary to supply reduced power to the sump heater 84 to avoid tripping of the breaker, the reduced heat output can significantly increase the time to heat the liquid supplied to the tub 14 up to a predetermined temperature for the selected cycle of operation, which can delay the whole cycle time and cause customer dissatisfaction. In another example, if only limited current is provided to the heater and fails to heat the laundry and/or liquid to the predetermined temperature, treating chemistry, which may be designed to treat laundry for a specific temperature range, may not properly treat laundry items as designed.

The invention addresses the problem by selectively operating the first and second heating elements in response to the amount of power being consumed by other components in the appliance 10. As the motor 88 is the component that consumes a relative large amount of power, the specific example will be in the interplay between the power consumption of the heater 84 and the motor 88. However, the invention is applicable to the interplay of the power consumption of any combination of power-consuming components of the appliance.

Looking at the specific example of the interplay between the heater 84 and the motor 88, to avoid an excessive current draw that would otherwise trip the breaker during a cycle of operation, the first heating element is configured to be ON throughout the entire cycle of operation, while the second heating element is configured to be only ON while the motor 88 is turned OFF. Selectively operating one of the dual heating elements in response to the ON/OFF state of the motor 88 provides for controlling the total current/power consumption of the washing machine 10 to keep it below the maximum current/power threshold.

Figure 3:
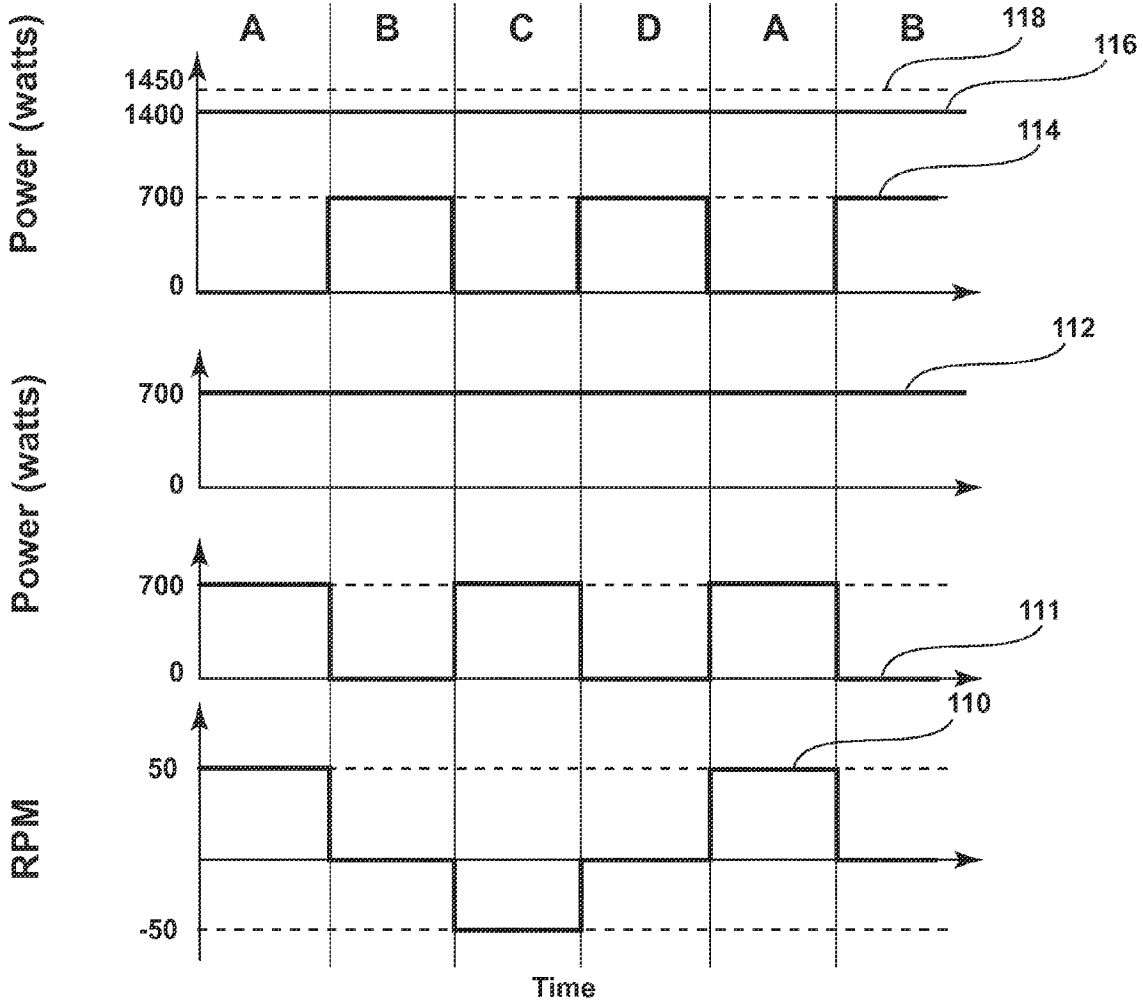
FIG. 3 is a schematic heating cycle for the first and second heating elements with respect to the motor operation according to a second embodiment of the invention.

FIG. 3 illustrates a schematic heating cycle for the first and second heating elements with respect to the motor operation according to a second embodiment of the invention. While both first and second heating elements may belong to one heater such as the sump heater 84 or steam generator 82, other configuration may be also possible. For example, the sump heater 84 may have the first heating element, and the steam generator 82 may have the second heating element. For illustrative purposes, the maximum power for the first and second heating element may be set as 700 watts, respectively. The power threshold of the washing machine 10 may be assumed to be 1450 watts, and the motor power for rotating the drum 14 at 50 rpm may be set as 700 watts.

The rotation of the motor 88 may be illustrated in motor speed profile 110. As illustrated, the motor 88 may be turned on to rotate the drum 16 in one direction for a predetermined time period (section A), then the motor 88 is turned off (section B). The motor 88 then rotates the drum 16 in an opposite direction (section C) for a predetermined time period, and then the motor 88 is turned off again (section D). The motor 88 may repeat the alternating ON/OFF operations for a predetermined time period before the motor 88 receives a signal from the controller 96 to stop the operation. Irrespective of the rotational direction of the drum 16, power consumption profile 111 for the drum 16 illustrates that the drum 16 may consume 700 watts for rotating the drum 16.

The consumed power for the first and second heating elements is illustrated in power consumption profiles for the first and second heating elements, 112, 114, respectively. When a heating cycle begins, first heating element may be configured to be ON state for an entire heating cycle. For example, the first heating element is continuously provided with 700 watts of power to provide thermal output to the laundry and/or liquid in the tub 14, regardless of the operation of motor 88 and/or the second heating element.

The second heating element may be configured to change the ON/OFF state, alternately with the ON/OFF state of the motor 88. For example, whenever the motor 88 is turned ON, the second heating element may be configured to turn OFF, and vice versa.

When the motor 88 is turned on, with the first heating element in the ON state (section A), the power consumption of the motor 88, first heating element and second heating element may be sensed by the sensors such as the motor torque sensor or temperature sensor. The sensors may provide the controller 96 with sensor signals that may be indicative of the current/power consumed by each component.

The power consumption for each electric component may be added, and then compared with the current/power threshold stored in the controller 96 to prevent any tripping of the washing machine 10. For example, while operating the motor 88 and the first heating element may require drawing 1400 watts, operating the motor 88, the first and second heating elements may necessitates drawing 2100 watts, which is above the maximum power threshold 118 of 1450 watts. Therefore, power may be supplied only to the motor 88 and the first heating element to maintain the total power consumption 116 at 1400 watts, while the second heating element may be turned off.

When the motor 88 is turned off to stop rotating the drum 14 (section B), the power consumption may be determined again by the sensors and controller 96. As the power consumption by the first and second heating element is calculated to be 1400 watts, which is less than the current/power threshold 118 of 1450 watts, the second heating elements is provided with current to increase the thermal output of the second heating element up to 700 watts for heating the laundry and/or liquid. In this case, the total power consumption 116 for first and second heating elements may be 1400 watts, which is below the current/power threshold 118 for the washing machine 10, and still provides safety margin.

When the motor 88 begins to rotate in an opposite direction according to a cycle of operation (section C), the power consumed by the motor 88 and the first heating element may be determined, and then compared with the current/power threshold to adjust the operation of electric components as necessary. Similar to section A, the second heating element may be turned off to avoid tripping.

Section D, which is similar to section B, may follow section C. The heating cycle comprising sections A, B, C and D, may continue for a predetermined time period before the heating elements receives a signal from the controller 96 to stop heating. It may be understood that the ON/OFF switching for the second heating element may be conducted by providing one or more relays or triac to the control circuit for heating elements.

FIG. 3 illustrates that the current/power may be discretely applied to the component. For example, the power consumption profile 114 may illustrate that the power level applied to the second heating element discretely switches between zero to 700 watts. While the current/power may be discretely adjusted between any two levels, it may be noted that current/power may be applied to the electric component in a continuous way. For example, the power consumption profiles, 111, 112 and 114 may be in the form of sinusoid wave such that the current/power that is applied to the component may increase or decrease in a continuous way.

Applying the current/power continuously to a component alternately with another component may be advantageous in terms of fully utilizing the maximum current/power allowable for the washing machine 10. For example, when the rotational speed of the motor 88 is configured to vary during the heating cycle, the power applied to the motor 88 may also vary. As the current/power threshold 118 is a fixed value for the washing machine 10, another component, such as the second heating element, may be provided with variable current/power such that the power applied to the second heating element may continuously increase when the motor speed continuously decreases. On the other hand, when the motor power increases, the power applied to the second heating element may be configured to continuously decrease. As a result, irrespective of the variable power consumption of the motor 88 during a cycle of operation, the components may use almost 100% of maximum current/power allowable for the washing machine 10, which may be advantageous in efficiently consuming power supplied to the washing machine 10.

While the claimed invention is described for the interplay between the motor 88 and heating elements, any combination of other power-consuming components for the washing machine 10 may be operably coupled to each other for controllably vary the power consumption level of the components. The non-limiting examples of other power-consuming components include interior lights, exterior lights, user interface, printed circuit board, memory, processor or the like. In one embodiment, one or more power-consuming components may be operably coupled to the motor 88, for selective ON/OFF cycling of one or more power-consuming components, depending on the ON/OFF cycling of the motor 88. In another embodiment, one or more power-consuming components may be operably coupled to the motor 88 and the heating elements for selectively varying the power consumption level of one or more power-consuming components. Selectively varying the power consumption level may include either discretely or continuously varying the power consumption level. Operating the laundry treating machine with all of the power drawing components coupled for selectively varying the power consumption levels of each component may be advantageous in further fully utilizing the power available for the laundry treating appliance.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of operating a laundry treating appliance having a rotatable drum at least partially defining a treating chamber, and a plurality of electrical components including a motor rotatably driving the drum, and a heater heating fluid provided to the treating chamber, which are controlled by a controller to implement at least one cycle of operation, the method comprising:

determining a parameter indicative of a total electricity consumed by at least the heater and the motor and providing the parameter to the controller;

comparing, with the controller, the consumed electricity to a threshold value for the parameter corresponding to a maximum allowed total electricity consumed; and in response to the comparing adjusting a thermal output of the heater to maintain the parameter below the threshold value.

2. The method of claim 1 wherein the determining the parameter comprises sensing the parameter.

3. The method of claim 1 wherein the parameter is indicative of an ON/OFF state of the motor.

4. The method of claim 3 wherein the adjusting of the thermal output comprises increasing the thermal output when the motor is in an OFF state.

5. The method of claim 1 wherein the threshold value is a current threshold for a breaker coupling the plurality of electrical components to an electrical supply.

6. The method of claim 5 wherein the parameter is indicative of a current draw of the consumed electricity.

7. The method of claim 1 wherein the adjusting the thermal output comprises variably adjusting the thermal output.

8. The method of claim 7 wherein the variably adjusting the thermal output comprises continuously, variably adjusting the thermal output.

9. The method of claim 8 wherein the continuously, variably adjusting the thermal output comprises continuously varying a current supplied to the heater.

10. The method of claim 7 wherein the variably adjusting the thermal output comprises discretely adjusting the thermal output.

11. The method of claim 10 wherein discretely adjusting the thermal output comprises selectively turning ON/OFF portions of the heater.

12. The method of claim 11 wherein selectively turning ON/OFF portions of the heater comprises leaving a first portion of the heater ON and selectively turning ON/OFF a second portion of the heater.

13. The method of claim 12 wherein the first and second portions have the same thermal output.

14. The method of claim 12 wherein the selectively turning ON/OFF the second portion of the heater is alternately synched with a turning OFF/ON of the motor, respectively.

* * * * *